US006145336A

United States Patent [19]

Miller et al.

[11] Patent Number: 6,145,336

[45] Date of Patent: Nov. 14, 2000

[54] PLASTIC EVAPORATOR MOUNT WITH TWO STEP MOLDING

[75] Inventors: Richard T. Miller; Gregory F. Krcma; Curt R. Cayemberg, all of Manitowoc; Raymond R. Haack, Mishicot; Charles E. Schlosser, Manitowoc; Bert Bodnar, Mukwonago, all of Wis.; William Aalto, Spring Grove, Ill.

[73] Assignee: Manitowoc Foodservice Group, Inc., Sparks, Nev.

[21] Appl. No.: 09/304,240

[22] Filed: May 3, 1999

[51] Int. Cl.[7] ..... F25D 19/00

[52] U.S. Cl. ..... 62/298; 62/297; 62/340; 312/296; 312/405; 312/404

[58] Field of Search ..... 62/298, 297, 340; 312/296, 405, 404

[56] References Cited

U.S. PATENT DOCUMENTS

| | | | |
|---|---|---|---|
| 3,655,210 | 4/1972 | Farnam et al. . | |
| 3,939,892 | 2/1976 | Farnam et al. . | |
| 3,944,235 | 3/1976 | Gordon . | |
| 4,607,499 | 8/1986 | Bolton et al. | 62/262 |
| 4,637,222 | 1/1987 | Fujiwara et al. | 62/244 |
| 4,637,456 | 1/1987 | Niggemann | 165/104.33 |
| 4,691,531 | 9/1987 | Clifton et al. | 62/263 |
| 4,802,060 | 1/1989 | Immel | 361/379 |
| 5,222,745 | 6/1993 | Akbar et al. . | |
| 5,272,888 | 12/1993 | Fisher et al. | 62/344 |
| 5,396,782 | 3/1995 | Ley et al. | 62/295 |
| 5,722,244 | 3/1998 | Shelton | 62/74 |

*Primary Examiner*—William Doerrler
*Assistant Examiner*—Mark Shulman
*Attorney, Agent, or Firm*—Steven P. Shurtz; Brinks Hofer Gilson & Lione

[57] ABSTRACT

The present invention uses a single molded piece of plastic as an evaporator frame. A low durometer gasket material is molded in place on the single molded piece of plastic. The gasket aids in sealing the evaporator frame and the evaporator pan.

16 Claims, 4 Drawing Sheets

PLASTIC EVAPORATOR MOUNT WITH TWO STEP MOLDING

BACKGROUND OF THE INVENTION

The invention relates to automatic ice making machines, and more particularly to an evaporator frame used in automatic ice making machines and the method of manufacture of a two step molded evaporator frame.

Automatic cube ice machines generally comprise a refrigeration system (compressor, condenser and evaporator), a plurality of ice-formation pockets (usually in the form of a grid of cells) and a water supply system. The evaporator is that part of the ice-making machine that has water flowing over a grid on the front and is cooled on the back by refrigerant tubing. An evaporator pan forms part of the evaporator in an automatic ice-making machine. The evaporator pan is generally a stamped metal pan to which the grid and refrigerant tubing may be attached.

Evaporator pans and grids are generally nickel or tin plated copper. Commonly, the ice cube grids and other items, such as studs, were attached to the evaporator pan to make the evaporator. After assembly, the evaporator pan was plated with nickel or tin. In the past, the studs projected from the back side of a flange and were welded onto the evaporator pan. The studs corresponded to openings in an evaporator frame. These studs were inserted into the openings in the evaporator frame and secured to the same through the use of washers and nuts. One of the functions of an evaporator frame is to mount an ice forming evaporator in an ice-making machine.

In the past, the evaporator frame could be made from four (or more) separate plastic components; commonly one component for each side of the evaporator pan. In addition, a gasket was used in assembling and sealing the frame and evaporator pan. The gasket itself could also be constructed of four (or more) pieces. In the past, these at least eight pieces, the four plastic side pieces and the four gasket pieces, were assembled together to make the evaporator frame system. In order to align the gasket and the frame, each piece of the evaporator frame ordinarily had a groove in it so that the gasket could be fitted to the plastic. Then a sealant was applied to fill in cracks between the side frame members at the corners of the pan.

One function of the gasket, which generally was placed between the pan and frame, was to prevent water from getting between the plastic frame components and pan. The plastic frame could crack if water froze between the pan and frame.

In many cases, evaporator frame pieces are made using an injection molding process. Beads of plastic are fed into a hopper, melted, and injected under pressure into a mold. The hot viscous plastic (or melt) flows throughout the mold in seconds, racing through channels and merging again, until every nook and cranny is uniformly filled. Instantaneously, another short surge of hot plastic packs the already cooling mold to compensate for shrinkage and the flow shuts off. Cooling takes place in a few more seconds and the injection molding process is completed. The mold opens, and out comes the pieces for an evaporator frame.

A variety of problems are associated with the evaporator frames and gaskets currently in use. For example, one of the many problems associated with prior evaporator frame systems was the difficulty in arranging the gasket with the evaporator pan so as to form a proper seal. Further, because past evaporator frame systems were made of so many parts, they were inefficient and could take an extensive amount of time to assemble. For example, because the studs were too long, a portion of the studs used to connect the evaporator pan and frame routinely broke off after the nuts were placed on them. Yet, in the past, these long studs were necessary because the studs had to be long enough to fit into the gun that was used to weld them onto the pan.

Time and complexity was also added to the assembly process because the top and bottom plastic components required access holes for tools used to tighten the nuts. Further, the corners of the frame commonly had to be sealed with room temperature vulcanization silicon sealant (RTV) after the frame was assembled. The RTV was applied in the corners where the four plastic pieces abut and four gasket pieces abut against each other.

These and other disadvantages of the past are solved by the present invention.

BRIEF SUMMARY OF THE INVENTION

The present invention generally includes an evaporator frame system for an ice making machine including a single piece molded evaporator frame. The evaporator frame has an evaporator pan opening. A flange is formed about the periphery of the evaporator pan opening. A single piece gasket is molded to the flange.

The method of the present invention includes molding a single piece evaporator frame having a flange surrounding an evaporator pan opening in the evaporator frame. In a second molding step, a gasket is molded to the flange of the evaporator frame.

As an advantage of the present invention, the amount of time required to assemble the evaporator frame is dramatically reduced. The cost of manufacture of the evaporator frame is significantly reduced due to decrease in material costs, time, and labor burden. Further, the present invention requires less skill to assemble.

Yet another advantage over the prior art multi-piece evaporator frames is the creation of a better seal because the gasket is a continuous gasket compressed to the pan rather than a multitude of pieces. Further, in one embodiment of the invention, the unique shape of the gasket assures that the gasket is always pressed against the pan to form a seal. In the past, proper sealing between the frame and pan required at least the proper positioning of the framed pan and torquing of the fasteners and operators sealing the corners of the gasket and pan.

As a further advantage of one embodiment, the elimination of welding studs to the pan reduces the chance of damage to the electrolysis nickel plating on the copper pan.

As an additional advantage of one embodiment of the present invention, the evaporator frame system is more sanitary and easily cleaned because generally all fasteners, fastener plugs, and caps are removed from direct contact with water being used to form the ice.

DETAILED DESCRIPTION OF THE DRAWINGS AND PREFERRED EMBODIMENT OF THE INVENTION

Figure 1:
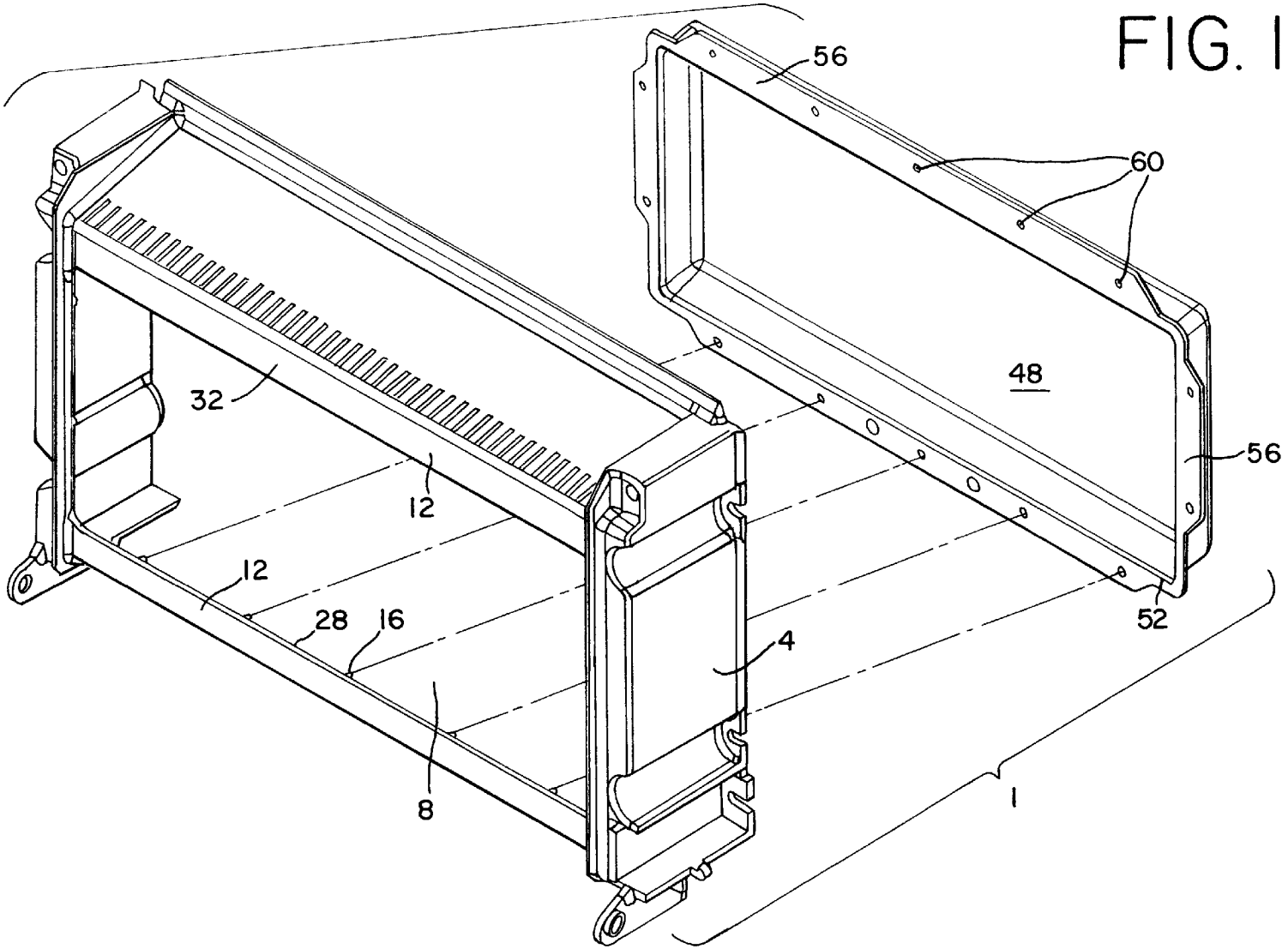
FIG. 1 is an exploded view of the evaporator pan in relation to a preferred evaporator frame of the present invention.

A preferred molded plastic evaporator frame system 1 for use in an ice-making machine 63 is shown in FIGS. 1–5. The evaporator frame system 1 includes a single piece molded evaporator frame 4, a single piece molded gasket 20, and an evaporator pan 48.

A method of making the novel evaporator frame system 1 of this invention includes the step of molding a single piece evaporator frame 4 having a flange 12 surrounding an evaporator pan opening 8 in the evaporator frame 4. Further, a gasket 20 having a lip 28 projecting into the evaporator pan opening 8 is molded to the flange 12 of the evaporator frame 4.

Figure 2:
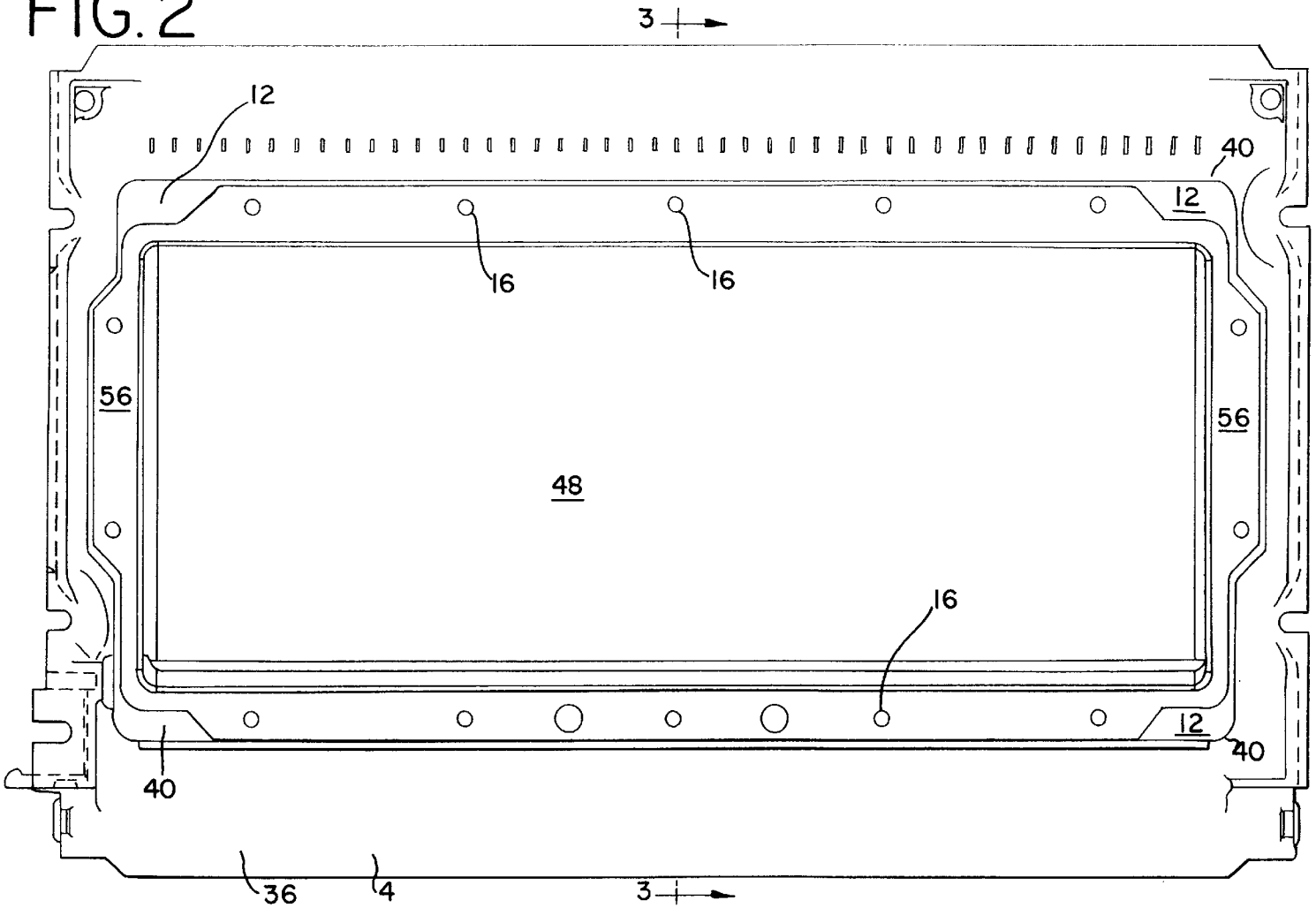
FIG. 2 is a back view of the evaporator pan seated in the evaporator frame of FIG. 1.

As shown in FIGS. 1 and 2, the evaporator frame 4 is made of a monolithic, single piece of molded plastic. The evaporator frame 4 has a first face 32 and a second face 36. The evaporator frame 4 is molded to include an evaporator pan opening 8. About the periphery of the evaporator pan opening 8 is a flange 12. On the second face 36 of the evaporator frame 4, an indentation 40 is molded as part of the flange 12. The indentation 40 is formed internally from the edge of the flange 12 following the circumference of the evaporator pan opening 8.

In one embodiment, the evaporator frame 4 is molded out of an acrylonitrile-butadiene-styrene (ABS) resin, although other resins, or mixtures of resins, could be used. Some of the characteristics of an ABS resin are mechanical toughness, wide service temperature range, good dimensional stability, chemical resistance, electrical insulating properties and ease of fabrication. The resins which may be used in the molding of the evaporator frame of this invention have a hardness within 100–120 Rockwell range, a viscosity within 1200–2000 poise and a heat deflection temperature within a 190–230 degrees Fahrenheit.

In one embodiment, the evaporator pan opening 8 may be generally centered in the evaporator frame 4.

Figure 4:
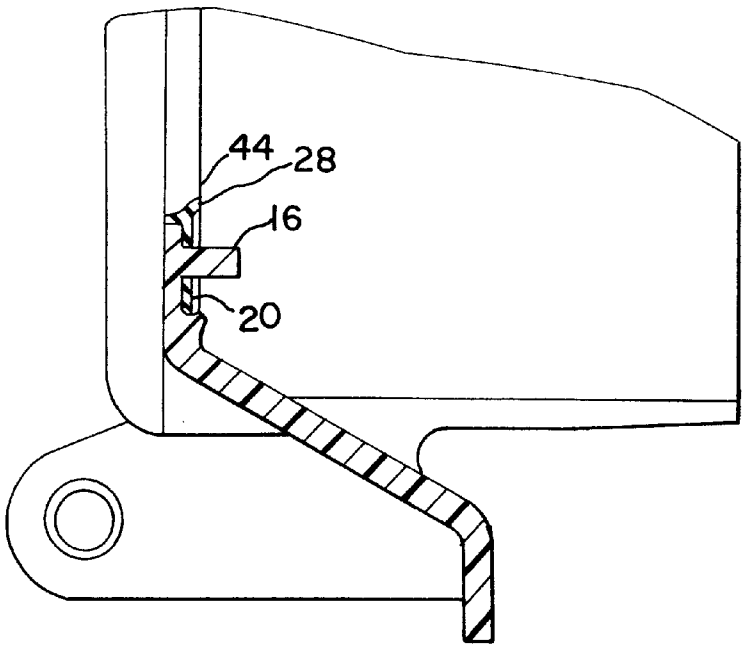
FIG. 4 is a cross sectional view of one corner of the evaporator frame of FIG. 1.
Figure 3:
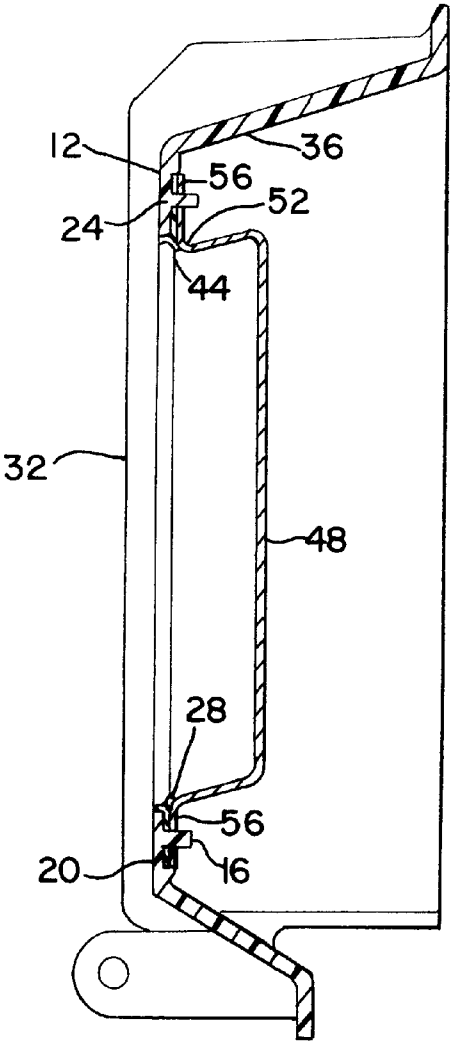
FIG. 3 is a cross sectional view taken along line 3-3 of FIG. 2 of the evaporator pan seated in the evaporator frame.

As shown in FIGS. 3 and 4, a gasket 20 is molded to the second face 36 of the evaporator frame 4. This is best performed as a second molding operation. The frame 4 is placed in a mold which has a cavity in the shape of the frame and gasket. Because the frame fills most of the cavity, only a small amount of material is injected into the cavity. In filling the remainder of the cavity, this material adheres to the surface of the frame 4. In one embodiment, the gasket 20 may be located molded to the evaporator frame 4 from the indentation 40 in the evaporator frame 4 and projecting outward toward and slightly into the center of the evaporator pan opening 8. The portion of the gasket 20 protruding from the flange 12 into the evaporator pan opening 8 is a lip 28. In the illustrated embodiment shown in FIG. 4, the lip 28 is angled so that the edge 44 protruding into the evaporator pan opening 8 is pointed upwards and away from the first face 32 of the evaporator frame 4. In an alternative embodiment, the gasket 20 may be molded to the evaporator frame 4 from the indentation 40 outward and ending at the edge of the flange 12.

In one rendition of the invention, the gasket 20 is made of a low durometer material. Durometer is a measure of the hardness of a material. A low durometer material would be a relatively soft material. In one embodiment, the gasket 20 may be molded of a thermoplastic elastomer alloy which is compatible with the resin from which the evaporator frame 4 is made. In additional renditions of the invention, the gasket 20 material may be National Sanitation Foundation (NSF) approved.

Thermoplastic elastomer alloys are generally designed for overmolding onto polycarbonate and ABS substrates. In a preferred embodiment, the thermoplastic elastomer alloy used is Versaflex OM 1040X available from GLS Corporation, Thermoplastic Elastomer Division, 740 Industrial Drive, Cary, Ill. 60013-1962. Versaflex OM 1040X alloy, when used in combination with polycarbonate and ABS, can provide an ergonomic, comfortable, soft-touch feel to a variety of applications. Some typical properties of Versaflex 1040X are found in Table I.

TABLE I

| Typical Physical Properties Reference ASTM Standards Noted | |
|---|---|
| Hardness, Shore A, (ASTM D2240), Injection molded | 40 |
| Specific Gravity, (D792) | 0.91 |
| Tensile Modulus, at 300% Elongation, psi, (D412), In Flow Direction | 335 |
| Tensile Strength at Break, psi, (D412), In Flow Direction | 540 |
| Percent Elongation at Break | 580 |
| Tear Strength, pli, die C, (D624), In Flow Direction | 100 |
| Color | Translucent |

In another rendition of the invention, Versaflex OM 1060X is another possible thermoplastic elastomer alloy which may be used as the gasket 20 material in the present invention. Available from GLS, Versaflex OM 1060X is designed for overmolding onto polycarbonate and ABS substrates. Some of the properties of Versaflex OM 1060X are found in Table II.

TABLE II

| Typical Physical Properties Reference ASTM Standards Noted | |
|---|---|
| Hardness, Shore A, (ASTM D2240), Injection molded | 60 |
| Specific Gravity, (D792) | 0.92 |
| Tensile Modulus, at 300% Elongation, psi, (D412), In Flow Direction | 540 |
| Tensile Strength at Break, psi, (D412), In Flow Direction | 655 |
| Percent Elongation at Break | 470 |
| Tear Strength, pli, die C, (D624), In Flow Direction | 145 |
| Color | Translucent |

Versaflex OM 1040X and OM 1060X alloy can be processed by using high shear rate methods including injection molding and extrusion. Polypropylene based color concentrates can be used to color Versaflex OM 1040X and OM 1060X alloys. Suggested processing parameters for both alloys are found in Table III.

TABLE III

| Suggested Processing Conditions | |
|---|---|
| Barrel temperature | |
| Rear | 410–430° F. |
| Front | 430–440° F. |
| Nozzle | 440–450° F. |
| Mold temperature | 70–100° F. |
| Back pressure | 0–50 psi |
| Injection rate | Moderate |

The preferred gasket 20 material of the present invention has a hardness within 30–60 shore A, a specific gravity within 0.89–1.00, a tensile strength within 400–700 psi, and a tear strength within 80–120 tear strength.

One of the novel points of the present invention is the very tight seal that is formed between the gasket 20 and the evaporator pan 48. One reason for this tight seal is due to the shape of the lip 28. In some embodiments, the lip 28 protrudes slightly upward and away from the first face 32 of the evaporator frame 4. The upward protruding lip 28 fits about the mouth 52 in the evaporator pan 48. Since the lip 28 fits snuggly to the mouth 52 in the evaporator pan 48, the seal between the evaporator pan 48 and frame 4 is improved. Further, the flexibility of the lip 28, that is, its capability to flatten or stretch out, also additionally aids in forming a tight fit between the lip 28 and the outer edge of the mouth 52 of the evaporator pan 48.

Figure 5:
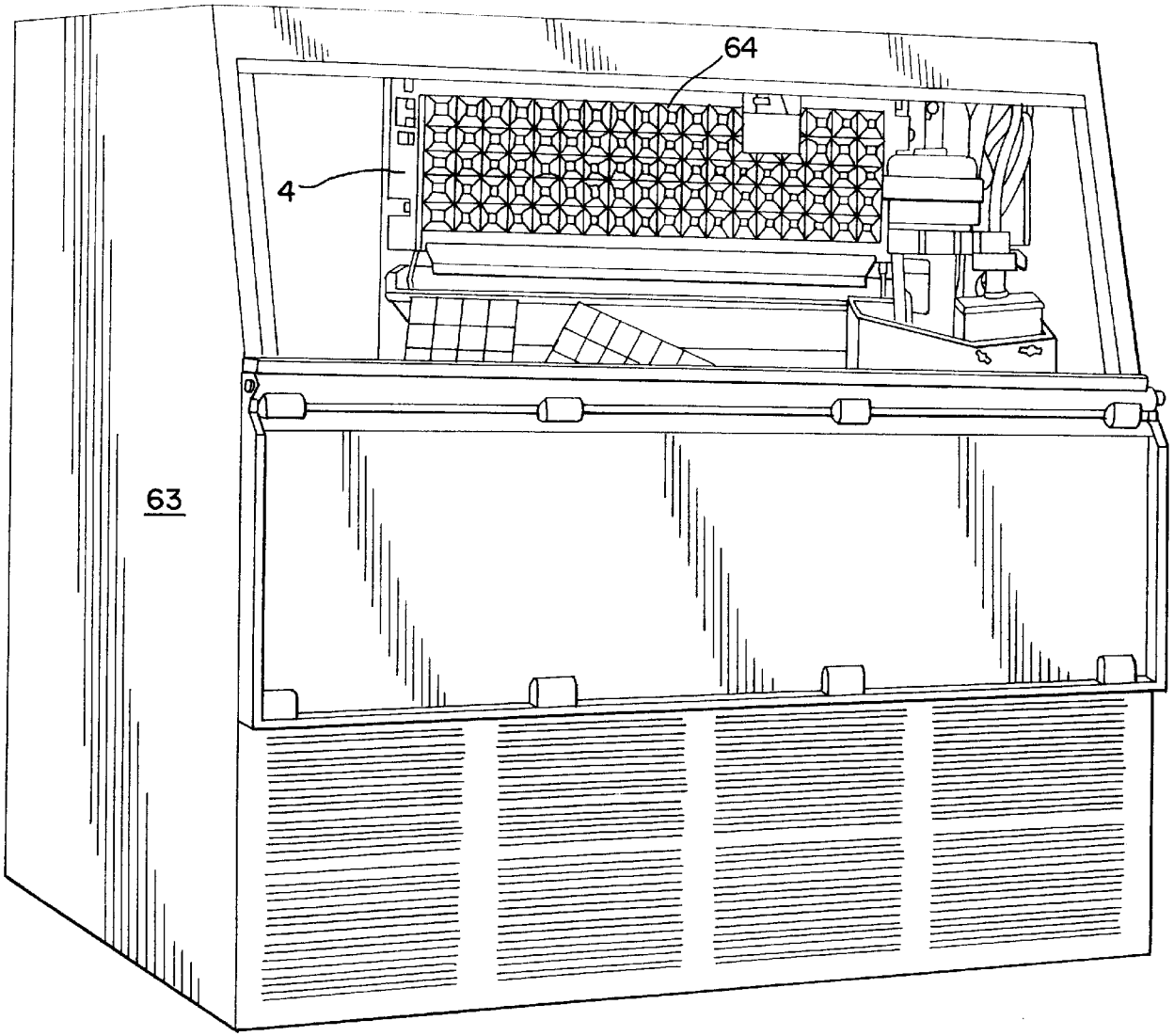
FIG. 5 is a perspective view of an ice making machine showing the evaporator system of the present invention.

As shown in FIG. 1, the evaporator pan 48 may be stamped from copper. The evaporator pan 48 is sized so as to be generally slightly smaller than the evaporator pan opening 8 in the evaporator frame 4. As shown in FIG. 1, the evaporator pan 48 has a mouth 52 which opens up into a recess. As shown in FIG. 5, a grid 64 upon which ice cubes are formed can be mounted in the recess of the evaporator pan 48. Tubing (not shown) can be attached to the evaporator pan 48 opposite the grid 64. A refrigerant is expanded and flows through the tube to cool the pan 48 and grid 64 below water freezing temperature. This assembly of the evaporator pan 48, grid 64, and refrigeration tubing forms the evaporator of an ice making machine 63.

Located about the periphery of the mouth 52 protrudes a pan flange 56. The pan flange 56 is alignable with the second face 36 of the flange 12 on the evaporator frame 4.

As shown in FIG. 1 and 2, an attachment mechanism 62 includes at least one post 16 and at least one post opening 60. In one embodiment, on the second face 36 of the evaporator frame 4, located within the area of the indentation 40 to the edge of the flange 12, is at least one, and preferably a minimum of fourteen posts 16 projecting from the flange 12. The posts 16 may be arranged in a regular array. Preferably, the posts 16 are formed as part of the monolithic molding of the evaporator frame 4. The gasket 20 is molded so as to encircle the base 24 of each post 16 protruding from the flange 12. At least one post-opening 60 on the pan flange 56 corresponds with the post 16 on the flange 12 of the evaporator frame 4. The posts 16 are heat staked with the gasket 20 therebetween, thereby attaching the evaporator pan 48 to the evaporator frame 4.

In an alternative embodiment not illustrated, at least one post 16 is located on the pan flange 56 and at least one corresponding post opening 60 is located on the flange 12 of the evaporator pan. The post 16 may likewise be heat staked with the gasket 20 therebetween thereby attaching the evaporator pan 48 to the evaporator frame 4.

In yet another embodiment, both the evaporator pan 48 and evaporator frame 4 may have at least one post opening 60 about the periphery of their respective flanges 56, 12. Individual posts 16 may be inserted into the post openings 60 and heat staked.

The method of the present invention includes molding the evaporator frame 4 in a single piece. The evaporator frame 4, in one embodiment, is molded having an evaporator pan opening 8 and a flange 12 surrounding the evaporator pan opening 8. Molded to the flange 12 is a single piece molded gasket 20. In one embodiment, the gasket 20 is molded having a lip 28 which projects into the evaporator pan opening 8. In an alternative embodiment, the lip 28 may be congruent with the edge of the flange 12.

In one rendition of the invention, the evaporator frame 4 is molded from at least one ABS resin. In yet another rendition of the invention, the gasket 20 is molded from at least at least one thermoplastic elastomer alloy. In a preferred embodiment, the thermoplastic elastomer alloy may be Versaflex 1040X.

In the method of manufacturing the evaporator frame system 1 of the present invention, as shown in FIGS. 1, 2 and 3, an evaporator pan 48 may be stamped from a suitable metal. As illustrated in FIG. 1, the evaporator pan 48 may be stamped with a pan flange 56 about the sides of the mouth 52.

In one embodiment, the pan flange 56 is formed so as to have at least one post opening 60 extending through the pan flange 56. Preferably, the post openings 60 of the evaporator pan 48 are aligned with at least one post 16 formed as part of the single piece molded evaporator frame 4. In assembling the evaporator frame system 1, as shown in FIG. 3, the posts 16 may be aligned and inserted into the post openings 60. The evaporator frame 4 and pan 48 may be united by heat staking the at least one post 16 while inserted in at least one post opening 60. In this manner, the posts 16 may be melted into a generally mushroom shape thereby uniting the evaporator pan 48 and frame 4. In a preferred embodiment, as shown in FIG. 3, the gasket 20 is located between the sealed evaporator frame 4 and pan 48 thereby aiding in sealing the area of joinder.

In an alternative embodiment (not shown), a plurality of post openings 60 are formed as part of the single piece molded evaporator frame 4. At least one post 16 is stamped as part of the evaporator pan 48 and are aligned with the post openings 60. The evaporator pan 48 and frame 4 are attached by heat staking the posts 16 within the post openings 60.

In yet another embodiment, both the evaporator pan 48 and evaporator frame 4 may have at least one post opening 60 about the periphery of their respective flanges 56, 12. Individual posts 16 may be inserted into the post openings 60 and heat staked.

Additionally, during manufacture of the evaporator frame system, the amount of pressure needed to assure gasket 20 compression should be determined prior to alignment of the evaporator pan 48 and evaporator frame 4. Since the gasket 20 is flexible, it responds to pressure. If too much pressure is used, then when the pressure is released, the gasket 20 may not seal between the evaporator pan 48 and frame 4. The pressure needed to assure gasket 20 compression is generally within the 30 to 60 range.

As noted, the discussion above is descriptive, illustrative and exemplary and is not to be taken as limiting the scope defined by the appended claims.

We claim:

1. An evaporator frame system for an ice making machine comprising:

a) a single piece molded evaporator frame, said evaporator frame having an evaporator pan opening;

b) a flange located about the periphery of the evaporator pan opening; and c) a gasket molded to the flange of the evaporator.

2. The evaporator frame system of claim 1 wherein the gasket further includes a lip, said lip formed from the gasket projecting outward from the flange and generally into the evaporator pan opening.

3. The evaporator frame system of claim 1 wherein the flange includes at least one attachment mechanism.

4. The evaporator frame system of claim 3 wherein the attachment mechanism includes at least one post projecting from the flange.

5. The evaporator frame system of claim 4 further including an evaporator pan; said evaporator pan having a pan flange; and at least one post opening located on said pan flange and aligned with said at least one post projecting from the frame flange.

6. The evaporator frame system of claim 1 wherein said evaporator frame comprises at least one acrylonitrile-butadiene-styrene plastic.

7. The evaporator frame system of claim 1 wherein the gasket comprises at least one thermoplastic elastomer alloy.

8. The evaporator frame system of claim 1 wherein the gasket comprises at least one low durometer material.

9. The evaporator frame system of claim 1 wherein the gasket includes at least one (generic name for Versaflex).

10. A method of manufacture of an evaporator frame system comprising the steps of:

a) molding a single piece evaporator frame having a flange surrounding an evaporator pan opening in the evaporator frame;

b) molding to the flange of the evaporator frame a gasket having a lip projecting into the evaporator pan opening.

11. The method of claim 10 wherein the evaporator frame is molded from at least one acrylonitrile-butadiene-styrene plastic.

12. The method of claim 10 wherein the gasket material is molded from at least one thermoplastic elastomer alloy.

13. The method of claim 10 wherein the gasket is molded from at least one (generic name for Versaflex).

14. The method of claim 10 further including the steps of:

a) stamping an evaporator pan having a pan flange, said pan flange having at least one post opening;

b) molding the flange of the evaporator frame to include at least one post; and c) aligning the at least one post opening with the at least one post on the evaporator frame.

15. The method of claim 14 further including the steps of:

a) inserting the at least one post into the at least one post opening in the evaporator pan; and b) uniting the evaporator frame to the evaporator pan by heat staking the at least one post while inserted in the at least one post opening.

16. An ice making machine comprising:

an evaporator frame system, said evaporator frame system including:

a) a single piece molded evaporator frame, said evaporator frame having an evaporator pan opening;

b) a flange located about the periphery of the evaporator pan opening; and c) a gasket molded to the flange of the evaporator.

* * * * *

UNITED STATES PATENT AND TRADEMARK OFFICE

CERTIFICATE OF CORRECTION

PATENT NO. : 6,145,336
DATED : November 14, 2000
INVENTOR(S) : Richard T. Miller et al.

It is certified that error appears in the above-identified patent and that said Letters Patent is hereby corrected as shown below:

Column 7,
Line 8, after "evaporator" insert -- frame --.

Column 8,
Line 34, after "evaporator" insert -- frame --.

Signed and Sealed this

Second Day of July, 2002

*Attest:*

*Attesting Officer*

JAMES E. ROGAN
*Director of the United States Patent and Trademark Office*